United States Patent [19]

Nakanishi

[11] Patent Number: 4,699,373

[45] Date of Patent: Oct. 13, 1987

[54] QUICK ACTING BANK NOTE RECOVERY SYSTEM

[75] Inventor: Tomoyuki Nakanishi, Moriyama, Japan

[73] Assignee: Omron Tateisi Electronics Co., Kyoto, Japan

[21] Appl. No.: 647,175

[22] Filed: Sep. 4, 1984

[30] Foreign Application Priority Data

Sep. 2, 1983 [JP] Japan ..... 58-162374

[51] Int. Cl.[4] ..... B65H 7/14

[52] U.S. Cl. ..... 271/258; 221/13; 235/375; 271/303

[58] Field of Search ..... 271/263, 258, 259, 303; 221/21, 13; 414/51; 198/356, 367; 235/375

[56] References Cited

U.S. PATENT DOCUMENTS

| | | | |
|---|---|---|---|
| RE28,660 | 12/1975 | Pettet | 271/263 |
| 4,365,797 | 12/1982 | Fitzpatrick et al. | 271/303 |
| 4,451,027 | 5/1984 | Alper | 271/259 X |
| 4,511,795 | 4/1985 | Wood et al. | 235/375 X |

*Primary Examiner*—Duane A. Reger
*Assistant Examiner*—Matthew C. Graham
*Attorney, Agent, or Firm*—Stevens, Davis, Miller & Mosher

[57] ABSTRACT

A cash dispenser includes a unit for taking out bank notes singly from a store, for accumulating a mass of counted notes, for forwarding this mass to a customer, and for forwarding the notes to be accumulated. The recovery system includes a unit for: checking the putatively single taken out notes as they are being forwarded and for determining whether each of them in reality is single or is an overlapped packet and for determining the approximate distance between them; recovering notes; selectively directing the putatively single notes which are being forwarded, either to the mass of counted notes, or to the recovering unit; selectively transferring the entire mass of counted notes to the recovering unit; and a control unit which: when the checking unit determines that one of the putatively single notes being forwarded by the forwarding unit in reality is single, controls the directing unit to direct it to be added to the mass of counted notes; but when the checking unit determines that this putatively single note in reality is an overlapped packet, then: if the checking unit determines that the approximate distance between this packet and the previous putatively single note is greater than a predetermined distance, controls the directing unit to direct this packet to the recovering unit; but otherwise controls the directing unit to direct this packet to be added to the mass of counted notes, and subsequently controls the transferring unit to transfer this mass of counted notes to the recovering unit.

4 Claims, 5 Drawing Figures

QUICK ACTING BANK NOTE RECOVERY SYSTEM

BACKGROUND OF THE INVENTION

The present invention relates to a device for recovering improperly counted out bank notes in an automatic cash dispenser or the like, and in particular to such a device which does not completely abort and restart the counting operation of bank notes unless necessary.

In an automatic cash dispenser, after it has been established how many bank notes should be counted out and delivered to a customer, these bank notes are separated one by one from a stack thereof and are counted out onto an accumulation pile in a bank note accumulation unit. Finally, after all the counting out is done, this accumulation pile is forwarded to the customer through a delivery slot or the like. It is inevitable that occasionally two or more of these bank notes stick together and are not properly separated, and are forwarded towards this accumulation pile in the counting process. In order to prevent delivery of this plurality of bank notes as one bank note, which would result in the disastrous delivery of too much money to the customer, the cash dispenser is typically provided with some means for detecting that such a superposed bank note packet has been mistakenly taken as one bank note, and this packet detection means may be provided at various points in the bank note counting path and may function in various ways.

It has been conventionally practiced to put the superposed bank note packet onto the accumulation pile of bank notes in any case, and, in the event that it is detected that such a multiple bank note packet has been mistakenly taken as one single bank note, then the entire accumulation pile of bank notes (the number of which cannot now be accurately relied upon) including this multiple bank note packet is recovered into a recovery unit, and the counting process is restarted from the beginning with an empty accumulation pile of bank notes. However, the efficiency of such a prior art bank note recovery system is very bad, because in the event of an error in bank note separation the bank note counting is started over again from scratch, and this can cause the waste of a great deal of time and repeated counting of money. Further, the amount of money that, on average, needs to be charged into the cash dispenser, in order to deliver a predetermined amount of money to a series of customers, becomes greater, since a relatively large amount of money is recovered into the recovery unit each time poor bank note separation occurs.

Accordingly, it might be conceived of to recover only the improperly separated multiple bank note packet, and not to disturb the accumulation pile of bank notes in the bank note accumulation unit. However, this simplistic concept is unworkable as such, because the length and the timing of picking up of such a superposed bank note packet are quite unpredictable—in the extreme case, such a superposed bank note packet could be many times longer in the direction of travel than a single bank note—and accordingly the problem arises that, when the distance between a properly separated and delivered single bank note and a following improperly separated multiple bank note packet becomes too small, a mechanism such as a flap mechanism which is used for switching the bank note or bank note packet between an acceptance path and a rejection and recovery path becomes incapable of responding properly to commands, so that even the bank note packet which is to be rejected from the counting process and recovered may not always be properly conducted to the bank note recovery unit.

SUMMARY OF THE INVENTION

Accordingly, it is the primary object of the present invention to provide a bank note recovery system, which operates reliably and efficiently.

It is a further object of the present invention to provide such a bank note recovery system, which reduces the time for correcting and recovering from an error of improper bank note separation.

It is a further object of the present invention to provide such a bank note recovery system, which does not unnecessarily recover any properly counted and accumulated bank notes, when the presence of an improperly separated multiple bank note packet is detected during the counting process.

It is a further object of the present invention to provide such a bank note recovery system, which reduces the average time required for paying out money to customers.

It is a further object of the present invention to provide such a bank note recovery system, which reduces the average amount of money which is required to be charged in the cash dispenser in order to pay out a predetermined amount of money to a predetermined number of customers.

It is a yet further object of the present invention to provide such a bank note recovery system, which if there is any danger of improper flap action still recovers the entire accumulated pile of bank notes in the bank note accumulation unit.

It is a yet further object of the present invention to provide such a bank note recovery system, which reduces the possibility of delivering too much money to a customer.

According to the most general aspect of the present invention, these and other objects are accomplished by providing, in a cash dispensing machine, comprising a means for taking out bank notes one by one from a bank note store, a means for accumulating a mass of counted bank notes, a means for forwarding said accumulated mass of counted bank notes to a customer, and a means for forwarding said one by one taken out bank notes to said bank note accumulating means: a bank note recovery system comprising: (a) a means for checking said putatively single taken out bank notes as they are being forwarded by said forwarding means, for determining whether each of said putatively single bank notes in reality is a single bank note or is an overlapped bank note packet, for also determining the approximate distance between consecutive ones of said putatively single bank notes, and for outputting signals representative of these determinations; (b) a means for recovering bank notes; (c) a means for selectively directing said putatively single bank notes which are being forwarded by said forwarding means, either to be added to said accumulated mass of counted bank notes, or to said bank note recovering means; (d) a means for selectively transferring said entire accumulated mass of counted bank notes to said bank note recovering means; and (e) a means, which receives said output signals of said checking means, for controlling said elements so as: (w) when said checking means determines that one of said putatively single bank notes being forwarded by said forwarding means in reality is a single bank note, to control said selective directing means so as to direct said single bank note to be added to said accumulated mass of counted bank notes; (x) when said checking means determines that one of said putatively single bank notes being forwarded by said forwarding means in reality is an overlapped bank note packet, then: (y) if said checking means determines that the approximate distance between this overlapped bank note packet and the previous putatively single bank note is greater than a certain predetermined distance, to control said selective directing means so as to direct said overlapped bank note packet to said bank note recovering means; but (z) if said checking means determines that the approximate distance between this overlapped bank note packet and the previous putatively single bank note is less than said certain predetermined distance, to control said selective directing means so as to direct said overlapped bank note packet to be added to said accumulated mass of counted bank notes in said accumulating means, and subsequently to control said selective transferring means to transfer said entire accumulated mass of counted bank notes to said bank note recovering means.

According to such a structure, when the distance between the bank notes or overlapped bank note packets is kept at a sufficiently great value, so that the action of the selective directing means such as a flap can sufficiently follow the delivery speed of these putatively single bank notes, then only the improperly taken out overlapped bank note packets are directed to the recovery means, and the counting process is not interrupted by this procedure. On the other hand, when the distance between an improperly taken out overlapped bank note packet and the previous putatively single bank note is less than said predetermined value, so that said selective directing means such as a flap cannot follow the delivery speed, then this overlapped bank note packet is temporarily added to the accumulated mass of counted bank notes, and subsequently the entire accumulated mass is directed to the recovery means, the counting process of course being interrupted at this time and in this case being required to be restarted from the beginning. Therefore, under normal conditions, only the improperly taken out overlapped bank note packets are intercepted and recovered, while, if the distance between the putative single bank notes has become short for any reason, if an overlapped bank note packet is detected, all the stored bank notes are rejected from the counting process and recovered. Accordingly, there is provided a bank note recovery system which operates reliably and efficiently, and which reduces the time for correcting and recovering from an error of improper bank note separation, because it does not unnecessarily recover any properly counted and accumulated bank notes when the presence of an improperly separated multiple bank note packet is detected during the counting process. Thus, the average time required for paying out money to customers is reduced. Also, because the average amount of recovered money is reduced, thereby the amount of money which is required to be charged in the cash dispenser in order to pay out a predetermined amount of money to a predetermined number of customers is reduced. And because this system, if there is any danger of improper flap action, still recovers the entire accumulated pile of bank notes in the bank note accumulation unit, thereby the possibility of delivering too much money to a customer is reduced.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENT

Figure 1:
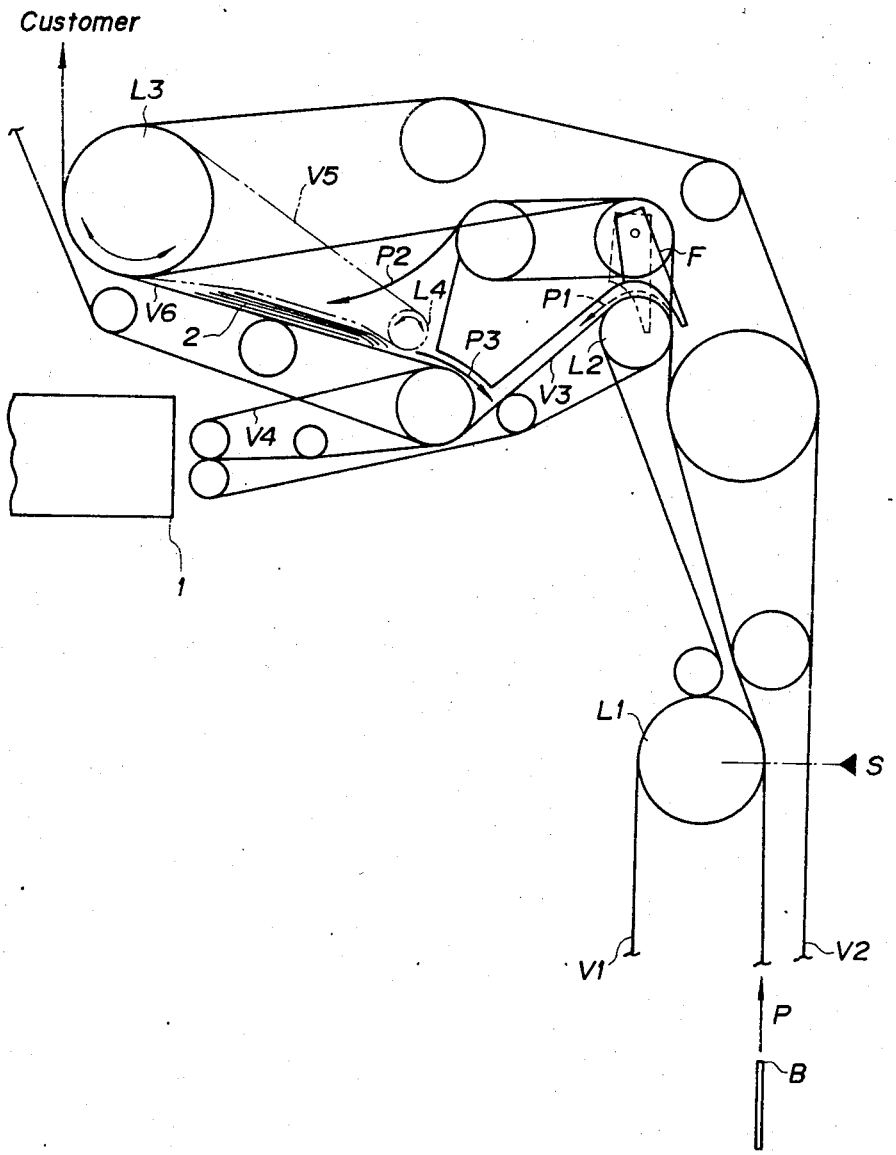
FIG. 1 is a schematic sectional view showing the preferred embodiment of the bank note recovery system of the present invention as incorporated in an automatic cash dispenser, along with associated elements of said cash dispenser.

The present invention will now be described in terms of its preferred embodiment and with reference to the accompanying drawings. FIG. 1 is a schematic sectional view showing said preferred embodiment of the bank note recovery system of the present invention, as incorporated in an automatic cash dispenser, and also shows various associated elements of said cash dispenser. Bank notes are in turn taken out from a bank note storage means, not shown in the figures but located below the apparatus shown in FIG. 1 from the point of view of that figure, by being sandwiched and held between two belts V1 and V2 which are stretched around various rollers and the confronting surfaces of which are pressed together. Such a bank note is shown by the symbol B, at the lower part of FIG. 1; this bank note B is being carried upwards in the figure by the belts V1 and V2 by being held between them, being thus moved along the path P in the upward direction. According to proper operation of the cash dispenser, the bank notes B are separated one by one from a stack of bank notes (not shown either) held in the aforementioned bank note storage means, by being separated from said bank note stack by a bank note separation means not shown in the figures either, and by being singly fed one at a time in between the belts V1 and V2 by a feeding means; but sometimes due to erroneous operation of said bank note separation means two or more bank notes B may be fed together between the belts V1 and V2, generally in an only partially overlapped position, thus forming a bank note block or packet, one of such packets being schematically shown at the lower part of FIG. 5. Such an erroneously picked up multiple bank note packet is almost always longer, from its leading edge to its trailing edge, than is a single bank note, due to incomplete overlapping of the bank notes in said bank note packet; and the present invention relates to the detection of the occurrence of such bank note picking up error, and to effective and efficient cancellation of its effects upon accurate money delivery.

This bank note or bank note packet B (which will be called a putative single bank note hereinafter) is lifted up along the path P by the belts V1 and V2, past a photoelectric sensor S only schematically shown. This sensor S, which may be per se conventional, normally in the presence of no putative single bank note opposite it outputs a low signal to a CPU 10 of a control device which will be described in detail hereinafter, but on the other hand when the leading edge of a putative single bank note passes said photoelectric sensor S its beam is blocked and its output signal changes from low to high, thus signalling the start of putative single bank note passage; and conversely when the trailing edge of said putative single bank note passes said photoelectric sensor S its beam is unblocked again and its output signal changes from high back to low, thus signalling the end of passage of said putative single bank note. And, since the speed of movement of the belts V1 and V2 is kept substantially constant, the timing of said alterations of the output signal of said sensor S is taken as indicative of the longitudinal extent of said putative single bank note, as will be explained later.

After passing the position of the sensor S, the putative single bank note B is further carried upwards by the belts V1 and V2 along the path P and approaches up to a roller L2 around which the belt V1 passes, where said putative single bank note B comes to the free edge of a flap F. This flap F can be positioned to either one of two positions: a putative single bank note rejection position, indicated in the drawing by the solid lines, in which it directs the putative single bank note along a lower rejection path P1 as indicated by the dashed line, to be recovered; and a putative single bank note acceptance position, indicated in the drawing by the dashed lines, in which it directs the putative single bank note along an upper acceptance path P2 as indicated by the solid line, to be accepted. The selective positioning of the flap F if performed by a control system which will be described hereinafter in detail.

When a putative single bank note is thus rejected and is sent along the lower rejection path P1 by the flap F being positioned to the rejection position as indicated by the solid lines, which as will be seen later occurs only when it is decided that said putative single bank note is in fact a plurality of bank notes partially overlapped on one another as a packet due to error having occurred when they were being taken out of the bank note storage means (not shown), said overlapped bank note packet is directed along the path P1 in between two belts V3 and V4, between which it is sandwiched and is then carried to a bank note recovery unit 1, not particularly shown with regard to its structure, which incorporates a bank note recovery container. On the other hand, when a putative single bank note is thus accepted and is sent along the upper acceptance path P2 by the flap F being positioned to the acceptance position as indicated by the dashed lines, which is done, as will be also seen later, either when it is decided that said putative single bank note is in fact a single bank note, or when it is decided that said putative single bank note is in fact a plurality of bank notes partially overlapped on one another as a packet and also that all the currently accumulated bank notes must now be rejected and recovered along with said bank note packet, then this single bank note or bank note packet is directed by the belt V2 along the path P2 onto a stack of bank notes lying on a belt V6 in a bank note accumulation unit 2, either to lie there while further single bank notes are (perhaps) laid on top of it, or to be later rejected along with said entire stack or pile. Further, according to the operation of the control system which will be described shortly, if the number of properly accepted single bank notes accumulated in said bank note pile in said bank note accumulation unit 2 reaches a certain predetermined amount (the proper amount to be given to the customer of the cash dispenser, calculated in advance), and further the lastly delivered bank note is a properly delivered single bank note, then all the bank notes stored in said bank note pile in said bank note accumulation unit 2 are released to the customer of the cash dispenser, by the rollers L3 and L4 being rotated in the clockwise direction as seen in FIG. 1, so as to carry the complete bank note pile upwards and leftwards between the belt V6 and another belt V5 out to a customer bank note delivery means not shown in the figure. On the other hand, as will shortly be seen in detail, if the control system determines that the last putative single bank note which was sent along the passage P2 and was deposited on said bank note pile in said bank note accumulation unit 2 was in fact doubly delivered, i.e. was in fact a packet consisting of a plurality of overlapped bank notes, then the entire bank note pile in said bank note accumulation unit 2 is of doubtful number, and so said entire bank note pile is sent, by the rollers L3 and L4 being rotated in the counterclockwise direction as seen in FIG. 1, downwards and rightwards on the belt V6 along a complete pile rejection and recovery path P3, so as to land on the aforementioned belt V3 so as to be entrained into the bank note rejection and recovery path P2 and so as to be, as in the previous case, taken in and sandwiched between the two belts V3 and V4 and carried to the bank note recovery container in the bank note recovery unit 1, and recovered therein.

In more detail, the operation of the control system for the flap F is as follows. The control system positions the flap F to its position shown in the figure by solid lines, so as to reject and recover the current putative single bank note, when the bank note delivery state detecting means incorporating the sensor S detects (a) that this current putative single bank note is in fact a multiple bank note packet composed of a plurality of bank notes partially overlapped by error; and (b) that the distance between this current putative single bank note and the previously delivered putative single bank note is greater than a certain predetermined value. Otherwise, the flap F is positioned by the control system therefor to its position shown in the figure by dashed lines, so as to accept the current putative single bank note and so as to store it in the pile in the bank note accumulation unit 2. In other words, if the bank note delivery state detecting means incorporating the sensor S detects that this current putative single bank note is in fact a single bank note, and is therefore not a multiple bank note packet composed of a plurality of bank notes partially overlapped by error, then the control system positions the flap F to its said position shown in the figure by dashed lines so as to accept this single bank note and so as to store it in the pile in the bank note accumulation unit 2, which is correct as being in the course of proper money counting operation; while, on the other hand, if said bank note delivery state detecting means incorporating the sensor S detects that (a) this current putative single bank note is in fact a multiple bank note packet composed of a plurality of bank notes partially overlapped by error, but also detects that the distance between this multiple bank note packet and the previously delivered putative single bank note is less than said certain predetermined value, then likewise said control system positions the flap F to its said position shown in the figure by dashed lines so as to store this multiple bank note packet in the pile in the bank note accumulation unit 2, which is not in the process of correct operation, but is inevitable as will be seen later due to the small distance between this incorrectly taken out multiple bank note packet and the previous putative single bank note. And in this latter case, if in fact the bank note delivery state detecting means detects that the distance between this multiple bank note packet and the previously delivered putative single bank note is greater than said certain predetermined value, then contrariwise said control system positions the flap F to its said position shown in the figure by solid lines so as to reject and recover this current putative single bank note.

Thereby, according to the operation of this shown preferred embodiment of the bank note recovery system of the present invention, when the bank notes are properly taken out singly from the bank note storage means (not shown) by the belts V1 and V2, and are properly singly carried upwards to the sensor S, then these bank notes are fed in turn along the bank note acceptance path P2, to be singly laid in the bank note pile being accumulated in the bank note accumulation unit 2, until the appropriate and correct number of bank notes has been accumulated in said pile in said bank note accumulation unit 2, and then this correct number of bank notes is delivered to the customer of the cash dispenser. On the other hand, in the case of error when it is detected that a plurality of bank notes has been picked up as an overlapped bank note packet from said bank note storage unit by the belts V1 and V2, instead of only a single bank note having been picked up as is proper, then if the distance between this overlapped bank note packet and the previous single bank note or overlapped bank note packet is greater than the predetermined value, so that the flap F can be relied upon in its switching action for divertingly directing the overlapped bank note packet, then only this overlapped bank note packet is switched into the rejection and recovery path P1 by the flap F being temporarily switched for the passage of this overlapped bank note packet only, and accordingly only this overlapped bank note packet is rejected from being put into the pile of bank notes in the bank note accumulation unit 2 and is sent to the bank note recovery unit 1; and subsequently the operation of the cash dispenser proceeds as before, with the pile of bank notes in the bank note accumulation unit 2 continuing to be built up one by one, and this entire pile not having been rejected unnecessarily. In this case, therefore, little interruption or delay to the bank note counting and delivery process is caused by the erroneous clumping together of the bank notes into the multiple bank note packet. On the other hand, if it is detected that the distance between this detected erroneously overlapped bank note packet and the previous single bank note or overlapped bank note packet is less than the predetermined value, so that the flap F cannot be relied upon in its switching action for divertingly directing the overlapped bank note packet, then temporarily this overlapped bank note packet is still carried along the acceptance path P2 and is put into the pile of bank notes in the bank note accumulation unit 2; but subsequently this entire pile of bank notes in the bank note accumulation unit 2 is rejected, by being sent down the complete rejection path P3, and is completely sent to the bank note recovery unit 1, thus causing a complete abort of the bank note accumulation process. In this case, therefore, a substantial interruption and delay to the bank note counting and delivery process is caused, since the entire counting process must be restarted from scratch; but this is inevitable in this case. However, this complete rejection case, in which the counting process is started again from the beginning, will occur but rarely as compared with the case outlined above in which only one putative single bank note is rejected as being a plural packet and then the counting process continues without complete restarting, and accordingly by the practice of the present invention very considerable increase in the efficiency of bank note counting and delivery is obtained.

Figure 2:
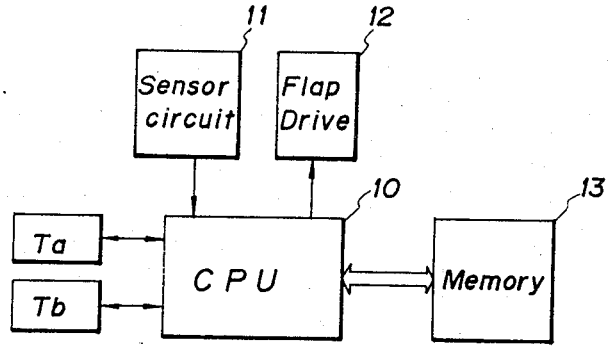
FIG. 2 is a schematic block diagram of a control system for said preferred embodiment of the bank note recovery system of the present invention.
Figure 3:
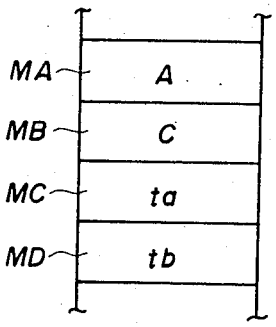
FIG. 3 is a map of an essential portion of the memory of a microcomputer incorporated in said preferred embodiment of the present invention.

Now, the control system for the above device will be described. FIG. 2 is a schematic block diagram of this control system for the preferred embodiment of the bank note recovery system according to the present invention. In this figure, the reference numeral 10 denotes a CPU (central processing unit) of a microcomputer, and 13 is the memory of said microcomputer, which is linked to said CPU by a bus, and which includes a ROM (read only memory) for storing a program for said microcomputer and constants and so on, and a RAM (random access memory) which is used as a work area for control, and for storing ongoing results and variables and counters and so on; these components of the memory 13 are not particularly individually shown. Further, Ta and Tb are timers which are connected to the CPU 10, 11 is a sensor circuit for processing the electrical signal from the photoelectric sensor S and for supplying a signal representative thereof to the CPU 10, and 12 is a flap drive circuit for receiving an output signal from the CPU 10 and for driving the flap F according to said signal. The initialization and the reading of the timers Ta and Tb are controlled by the CPU 10 as will be explained shortly. FIG. 3 is a map of an essential portion of the aforesaid ROM (read only memory). In this part of the memory, the location MA is used for storing the number of bank notes which are required to be given to the customer by the cash dispenser, and the location MB is used for storing the number of single bank notes which have currently been accumulated in the bank note pile in the bank note accumulation unit 2. Further, the location MC is used for storing the time ta measured by the timer Ta, which as will be seen later corresponds to the time interval between the time point at which the front end of a putative single bank note passes the sensor S so as to cause its signal to change from low to high and the subsequent time point at which the rear end of said putative single bank note subsequently passes the sensor S so as to cause its signal to change from high to low; this time interval corresponds to the length of the putative single bank note, because of the uniform movement speed of the belts V1 and V2, and hence can be used to authoritatively determine whether in fact this putative single bank note is actually a single bank note or in reality is an overlapped bank note packet, with a small margin of error. And yet further the location MD is used for storing the time tb measured by the timer Tb, which as will be seen later corresponds to the time interval between the time point at which the rear end of the last putative single bank note passed the sensor S so as to cause its signal to change from high to low and the subsequent time point at which the front end of the current putative single bank note subsequently has passed the sensor S so as to cause its signal to change from low to high; this time interval corresponds to the distance between said last putative single bank note and said current next putative single bank note, and hence can be used to determine whether the operation of the flap F can be relied upon for directing properly these putative single bank notes.

Figure 5:
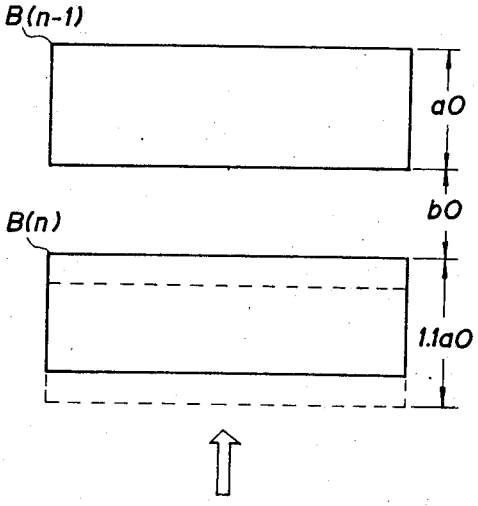
FIG. 5 is a schematic diagram for showing the relationship between two putative bank notes which have been successively taken out from a storage means therefor, during the operation of said preferred embodiment of the present invention.

Now, with reference to FIG. 4, which is a flow chart for illustrating the operation of a part of the program stored in said ROM of said microcomputer, the operation of said preferred embodiment of the present invention will be described. In this connection, FIG. 5 is a schematic diagram showing the positional relationship between two putative single bank notes, designated as B(n−1) and B(n), consecutively taken out from the bank note storage means by the belts V1 and V2 and being moved past the sensor S in the upward direction from the point of view of the figure.

Figure 4:
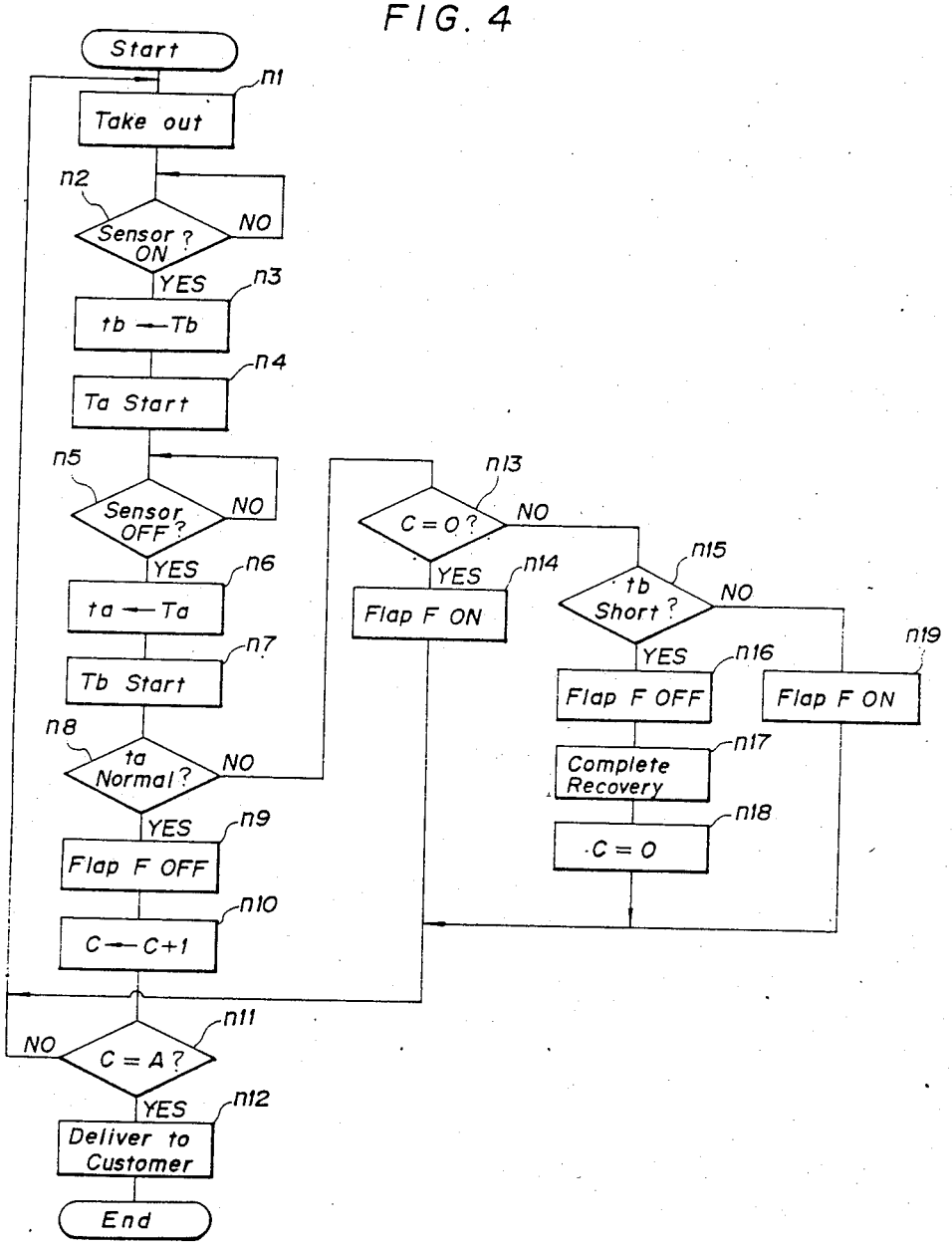
FIG. 4 is a flow chart for illustrating the operation of a part of the program of said microcomputer, during the operation of said preferred embodiment of the present invention.

After the start of this part of the program of FIG. 4 (for other steps thereof, including initialization steps and so on, exist and are performed but are not particularly shown), in the step n1 the action is performed of taking out by the belts V1 and V2 a next putative single bank note from the bank note storage unit not shown in FIG. 1. Next, in the step n2, a decision is made as to whether the output of the sensor S is in the on (or high) state or not, and if the result of this decision is NO, so that the output of the sensor S is in the off or low state indicating that the front end of this next taken out putative single bank note has not yet reached the sensor S in its upward travel, then the flow of program control is transferred back to this step n2 again, and thus the program flow performs a tight repetitive loop and does not advance further until the front end of this next putative single bank note reaches the sensor S. On the other hand, as soon as the result of this decision in step n2 is YES, so that the output of the sensor S is in the on or high state indicating that the front end of this next taken out putative single bank note has just now reached the sensor S in its upward travel, then the flow of program control passes on to the next step n3.

In the step n3, the value of the time count of the second timer Tb is stored in the memory storage location MD as the time tb, which is the time which has elapsed between the time point at which the rear end of the last putative single bank note passed the sensor S and the present time point at which the front end of this next putative single bank note subsequently has now passed the sensor S. This time interval tb corresponds to the distance as shown in FIG. 5 between said last putative single bank note B(n−1) and this next putative single bank note B(n), i.e. to the distance indicated in the figure by b0. As will be seen in the description of the step n7, the second timer Tb was initialized to zero and started running, just at said time point when the rear end of said last putative single bank note passed the sensor S, in the previous cycle of this FIG. 4 program.

Next, in the step n4, the timer Ta is initialized to zero and started running, so as to start timing the time interval ta necessary for passage of this next putative single bank note past the sensor S. Next, in the step n5, a decision is made as to whether the output of the sensor S is in the off (or low) state or not, and if the result of this decision is NO, so that the output of the sensor S is in the on or high state indicating that the rear end of this next taken out putative single bank note has not yet reached the sensor S in its upward travel, then the flow of program control is transferred back to this step n5 again, and thus the program flow again performs a tight loop and does not advance further until the rear end of this next putative single bank note reaches the sensor S. On the other hand, as soon as the result of this decision in step n5 is YES, so that the output of the sensor S is in the off or low state indicating that the rear end of this next taken out putative single bank note has just now reached the sensor S in its upward travel, then the flow of program control passes on to the step n6.

In the step n6, the value of the time count of the first timer Ta is stored in the memory storage location MC as the time interval ta which has elapsed between the time point at which the front end of this next putative single bank note passed the sensor S and the present time point at which the rear end of this next putative single bank note subsequently has just now passed said sensor S. This time interval ta corresponds to the distance as shown in FIG. 5 between the front and the rear ends of this next putative single bank note B(n), i.e. to the distance which is therein shown as 1.1a0 (in this shown illustrative case this next putative single bank note is in fact not a single bank note, but is a pair of bank notes partly overlapped together, and thus is somewhat wider than the width a0 of a single bank note). And next, as mentioned above, in the step n7 the second timer Tb is initialized to zero and started running, at this said time point when the rear end of this next putative single bank note passes the sensor S, so that said second timer Tb runs until its counted time value is stored in the step n4 of the next repetition of the cycle of this FIG. 4 program.

Next, in the step n8, it is determined whether the value of this counted time interval ta (in the memory storage location MC) is normal or not; in other words, whether it is sufficiently close to a standard value to indicate that this current putative single bank note really is a single bank note, or not. In the shown example in FIG. 5, the value of ta corresponds to a width of 1.1a0, where a0 is the standard width value, and this value of ta would be judged to be abnormal and would be sufficient to cause a NO decision in this step 8. If the answer to this step n8 decision is NO, thus indicating that this putative single bank note is in fact a plurality of overlapped bank notes, then the flow of program control passes next to the step n13 which will be explained hereinafter. On the other hand, if the answer to this decision is YES, thus indicating that this putative single bank note is in fact a single bank note, then the flow of program control passes next to the step n9 in which the flap control circuit 12 is actuated so as to cause the flap F to be positioned to the putative single bank note acceptance position, indicated in FIG. 1 by the dashed lines, in which said flap F directs this now definite single bank note along the upper acceptance path P2 as indicated by the solid line to be accepted and to be added to the pile of accepted single bank notes in the bank note accumulation unit 2, to lie there while further single bank notes are (perhaps) laid on top of it, during further repetitions of the main cycle of this FIG. 4 program.

Next in this acceptance flow path, in the step n10, the value of the bank note count C, stored in the memory location MB and representative of the number of single bank notes in this pile of accepted single bank notes in the bank note accumulation unit 2, is incremented, since this single bank note addition to the single bank note pile has been successful. And next, in the step n11, a decision is made as to whether or not this total number C of single bank notes in the pile of accepted single bank notes in the bank note accumulation unit 2 is yet equal to the certain predetermined value stored in the memory location MA and denoted by the symbol A, which is the proper amount to be given to the customer of the cash dispenser and which is calculated previously to the operation of the program of FIG. 4 by another program (not particularly described herein) for the microcomputer. If this decision of step n11 gives a YES result, then the flow of program control passes to the step 12, in which the microcomputer so actuates the mechanism of FIG. 1 as to cause all the bank notes stored in the bank note pile in the bank note accumulation unit 2 to be released to the customer of the cash dispenser by the rollers L3 and L4 being rotated in the clockwise direction as seen in FIG. 1, so as to carry the complete accumulated bank note pile upwards and leftwards between the belt V6 and the other belt V5 out to the previously mentioned customer bank note delivery means not shown in the figure. On the other hand, if the decision of step n11 gives a NO result, so that the number C of bank notes in the pile of accepted bank notes in the bank note accumulation unit 2 has not yet become equal to the predetermined proper amount A (in memory location MA) to be given to the customer of the cash dispenser, then the flow of program control returns to the step n1, to execute the main loop of this FIG. 4 program again and to add another single bank note to the bank note pile in the bank note accumulation unit 2. Thus, assuming proper operation of the means (not shown) for taking out bank notes from the bank note storage means, i.e. assuming that only single bank notes are taken out therefrom, this main program cycle is executed a total of A times, and then the flow of control exits via the step n12 described above to the end of the program.

On the other hand, if in the step n8 it is detected that the value ta of the counted time (in the memory storage location MC) is not normal, thus indicating that this putative single bank note is in fact a plurality of overlapped bank notes, then the flow of program control passes next to the step n13, which initiates the part of the program of FIG. 4 that deals with such a case of an erroneously picked up overlapped bank note packet.

In this step n13, a test is made as to whether the value of the count C stored in the memory location MC is zero or not, i.e. as to whether or not any bank notes are currently stored in the pile of accepted single bank notes in the bank note accumulation unit 2. If said pile of accepted single bank notes is currently empty, then no problem arises with respect to the distance tb between this current putative single bank note (now determined to be an erroneously picked up overlapped bank note packet) and the last (since in fact this value tb is meaningless at this point), and accordingly the flow of program control is transferred to the step n14, in which the flap control circuit 12 is actuated so as to cause the flap F to be positioned to the putative single bank note rejection and recovery position, indicated in FIG. 1 by the solid lines, in which it directs this overlapped bank note packet along the lower rejection and recovery path P1 as indicated by the dashed line to be taken by the belts V3 and V4 into the bank note recovery means, not shown; and then as before the flow of control is transferred to the step n1, to perform the main loop of this FIG. 4 program again and hopefully this time to add a properly taken out and single bank note to start the bank note pile in the bank note accumulation unit 2. On the other hand, if the result of the decision in the step n13 is NO, so that already some bank notes are present in the single bank note pile in the bank note accumulation unit 2, then the flow of program control is passed next to the step n15.

In this step n15, a decision is made as to whether the time value tb, counted by the second timer Tb and stored in the memory location MD, is short, or not; i.e., this time value tb is compared with a predetermined value, and it is determined whether it is less than this predetermined value, or not. This time value tb is representative of the distance, denoted in FIG. 5 by b0, between the rear end of the previous putative single bank note B(n−1) and the front end of this next putative single bank note B(n), which has now been determined to be an overlapped bank note packet. And the predetermined time value is selected so as to define the minimum acceptable distance between putative bank notes for proper switching by the flap F, as described earlier in this specification. Thus, if the result of this decision in the step n15 is YES, indicating that the distance between this multiple bank note packet and the previous putative single bank note is too short for proper operation of the flap F, then the flow of program control passes to the step n16, and otherwise the flow of program control passes to the step n19.

In this step n19, since it has been determined that the interval between this multiple bank note packet and the previous putative single bank note is sufficiently long for proper control operation of the flap F to reject and recover this multiple bank note packet alone, then the flap control circuit 12 is actuated so as to cause the flap F to be positioned to the putative single bank note rejection and recovery position, indicated in FIG. 1 by the solid lines, in which it directs this overlapped bank note packet along the lower rejection and recovery path P1 as indicated by the dashed line to be taken by the belts V3 and V4 into the bank note recovery means, not shown; and then as before the flow of control is transferred to the step n1, to perform the main loop of this FIG. 4 program again and hopefully this time to add a properly taken out and single bank note to the bank note pile in the bank note accumulation unit 2.

On the other hand, if the flow of control has passed to the step n16, then it has been determined that the interval between this multiple bank note packet and the previous putative single bank note is too short for proper control operation of the flap F to reject and recover this multiple bank note packet alone, and therefore unavoidably all the bank notes previously accumulated in the pile in the bank note accumulation unit 2 will have to be rejected and recovered along with this multiple bank note packet; hopefully, this eventuality will only occur rarely. In any case, in this step n16 the microcomputer actuates the flap control circuit 12 so as to cause the flap F to be positioned to the putative single bank note acceptance position, indicated in FIG. 1 by the dashed lines, in which said flap F directs this now definite multiple bank note packet along the upper acceptance path P2 as indicated by the solid line to be accepted and to be temporarily added to the pile of accepted single bank notes in the bank note accumulation unit 2, to lie there for the time being. And next the flow of control proceeds to the step n17.

In this step n17, this entire bank note pile in the bank note accumulation unit 2 is sent, by the microcomputer rotating the rollers L3 and L4 in the counterclockwise direction as seen in FIG. 1, downwards and rightwards on the belt V6 along the complete pile rejection and recovery path P3, so as to land on the aforementioned belt V3 so as to be entrained into the bank note rejection and recovery path P2 and so as to be taken in and sandwiched between the two belts V3 and V4 and carried to the bank note recovery container in the bank note recovery unit 1, and completely recovered therein. And next, in the step n18, the count value C held in the memory location MB and representing the number of bank notes held in the pile of bank notes in the bank note accumulation unit 2 is set to zero, since this pile of bank notes has been completely emptied by being recovered, and then as before the flow of control is transferred back to the step n1, to perform the main loop of this FIG. 4 program again and hopefully this time to add a properly taken out and single bank note to restart the bank note pile in the bank note accumulation unit 2.

Therefore, according to the shown structure, when the distance between the bank notes or overlapped bank note packets is kept at a sufficiently great value, so that the action of the flap F can sufficiently follow the delivery speed of the putatively single bank notes, then only the improperly taken out overlapped bank note packets are directed to the recovery unit 1, and the counting process is not interrupted by this recovery procedure. On the other hand, when the distance between an improperly taken out overlapped bank note packet and the previous putatively single bank note is less than the predetermined value, so that the flap F cannot follow the bank note delivery speed, then this overlapped bank note packet is temporarily added to the accumulated mass of counted bank notes in the bank note accumulation unit 2, and subsequently the entire accumulated mass is directed to the recovery unit 1, the counting process of course being interrupted at this time and in this case being required to be restarted from the beginning. Therefore, under normal conditions, only the improperly taken out overlapped bank note packets are intercepted and recovered, while, if the distance between the putative single bank notes has become short for any reason, if an overlapped bank note packet is detected, all the stored bank notes are rejected from the counting process and recovered. Accordingly, there is provided a bank note recovery system which operates reliably and efficiently, and which reduces the time for correcting and recovering from an error of improper bank note separation, because it does not unnecessarily recover any properly counted and accumulated bank notes when the presence of an improperly separated multiple bank note packet is detected during the counting process. Thus, the average time required for paying out money to customers is reduced. Also, because the average amount of recovered money is reduced, thereby the amount of money which is required to be charged in the cash dispenser in order to pay out a predetermined amount of money to a predetermined number of customers is reduced. And because this system, if there is any danger of improper flap action, still recovers the entire accumulated pile of bank notes in the bank note accumulation unit, thereby the possibility of delivering too much money to a customer is reduced.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. In a cash dispensing machine, comprising a means for taking out bank notes one by one from a bank note store, a means for accumulating a mass of counted bank notes, a means for forwarding said accumulated mass of counted bank notes to a customer, and a means for forwarding said one by one taken out bank notes to said bank note accumulating means, a bank note recovery system comprising:

(a) a means for checking said putatively single taken out bank notes as they are being forwarded by said forwarding means, for determining whether each of said putatively single bank notes in reality is a single bank note or is an overlapped bank note packet, for also determining an approximate distance between consecutive ones of said putatively single bank notes, and for outputting signals representative of these determinations;

(b) a means for recovering bank notes;

(c) a means for selectively directing said putatively single bank notes which are being forwarded by said forwarding means, either to be added to said accumulated mass of counted bank notes, or to said bank note recovery means;

(d) a means for selectively transferring said entire accumulated mass of counted bank notes to said bank note recovering means; and (e) a means, which receives said output signals of said checking means, for controlling said elements so as:

(w) when said checking means determines that one of said putatively single bank notes being forwarded by said forwarding means in reality is a single bank note, to control said selective directing means so as to direct said single bank note to be added to said accumulated mass of counted bank notes;

(x) when said checking means determines that one of said putatively single bank notes being forwarded by said forwarding means in reality is an overlapped bank note packet, then:

(y) if said checking means determines that the approximate distance between this overlapped bank note packet and the previous putatively single bank note is greater than a certain predetermined distance, to control said selective directing means so as to direct said overlapped bank note packet along a predetermined path to said bank note recovering means; but (z) if said checking means determines that the approximate distance between this overlapped bank note packet and the previous putatively single bank note is less than said certain predetermined distance, to control said selective directing means so as to direct said overlapped bank note packet to be added to said accumulated mass of counted bank notes in said accumulating means, and subsequently to control said selective transferring means to transfer said entire accumulated mass of counted bank notes along said predetermined path to said bank note recovering means.

2. A bank note recovery system according to claim 1, wherein said checking means comprises a means for detecting the passage of the leading edge of a putative bank note packet and a means for detecting the passage of the trailing edge of a putative bank note packet.

3. A bank note recovery system according to claim 2, wherein said control means determines that said putative single bank note is in reality an overlapped bank note packet, if the time interval between the output signal from said leading edge detecting means and the subsequent output signal from said trailing edge detecting means is greater than a predetermined value.

4. A bank note recovery system according to claim 2, wherein said control means determines the approximate distance between this overlapped bank note packet and the previous putatively single bank note from the time interval between the previous output signal from said trailing edge detecting means and the subsequent last output signal from said leading edge detecting means.

* * * * *